United States Patent [19]

Wirz

[11] Patent Number: 5,042,383

[45] Date of Patent: Aug. 27, 1991

[54] IMPRESSION CYLINDER WITH DOMELIKE SURFACE PORTIONS OF UNIFORM HEIGHT

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 815,776

[22] Filed: Jan. 2, 1986

Related U.S. Application Data

[63] Continuation of Ser. No. 718,830, Apr. 2, 1985, abandoned, continuation of Ser. No. 632,676, Jul. 19, 1984, abandoned, continuation of Ser. No. 490,977, May 2, 1983, abandoned, continuation of Ser. No. 357,663, Mar. 12, 1982, abandoned, continuation of Ser. No. 171,837, Jul. 24, 1980, abandoned, continuation of Ser. No. 927,664, Jul. 24, 1978, abandoned, continuation of Ser. No. 752,094, Dec. 20, 1976, abandoned, which is a continuation-in-part of Ser. No. 614,609, Sep. 18, 1975, abandoned.

[30] Foreign Application Priority Data

Sep. 27, 1974 [DE] Fed. Rep. of Germany ..... 2446188

[51] Int. Cl.[5] ..... B41F 13/18

[52] U.S. Cl. ..... 101/420; 101/422; 29/121.1

[58] Field of Search ..... 101/420, 422; 29/121.1

[56] References Cited

U.S. PATENT DOCUMENTS

| | | | |
|---|---|---|---|
| 1,210,375 | 12/1916 | Decker | 101/420 |
| 1,273,726 | 7/1918 | Roesen | 101/420 |
| 1,675,000 | 6/1928 | Spence | 101/420 |
| 1,789,273 | 1/1931 | Hone | 101/420 |
| 2,085,845 | 7/1937 | Binkley | 101/420 |
| 2,555,319 | 6/1951 | Cross | 101/420 |
| 2,740,355 | 4/1956 | Wimpfeiner | 101/420 |
| 3,177,558 | 4/1965 | Gronholz et al. | 29/121.8 |
| 3,308,522 | 3/1963 | Miller | 101/420 |
| 3,410,162 | 11/1968 | Ruggeri | 29/121.8 |
| 3,602,140 | 8/1971 | Sudduth | 101/420 |
| 3,846,221 | 11/1974 | Golec | 29/121.8 |

*Primary Examiner*—Clifford D. Crowder

*Attorney, Agent, or Firm*—Herbert L. Lerner; Laurence A. Greenberg

[57] ABSTRACT

A sheet guiding cylinder of a rotary printing press includes a cylindrical member, at least the outer surface portion of which is formed of chemically resistant, wear-resistant and unyielding material and has a multiplicity of elevated solid surface portions consisting of a distribution of domelike structures of uniform height formed thereon.

7 Claims, 3 Drawing Sheets

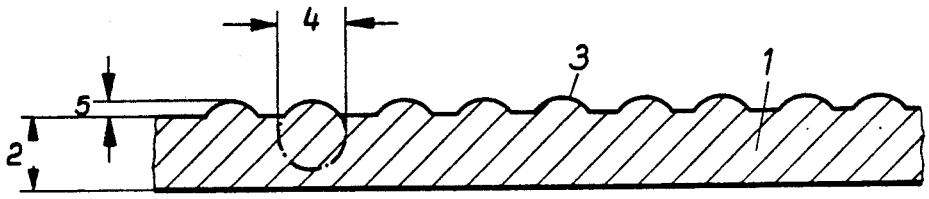
Fig. 1
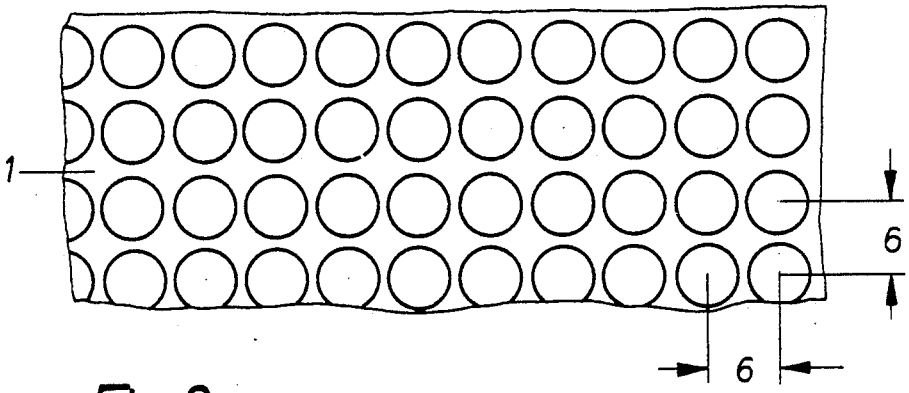
Fig. 2
Fig. 5
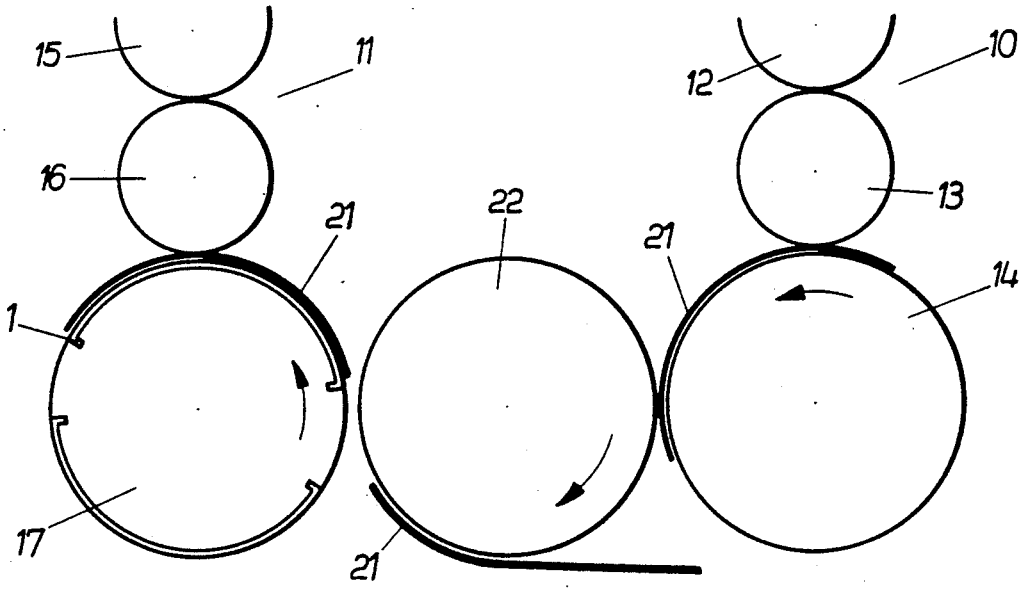

Fig. 3
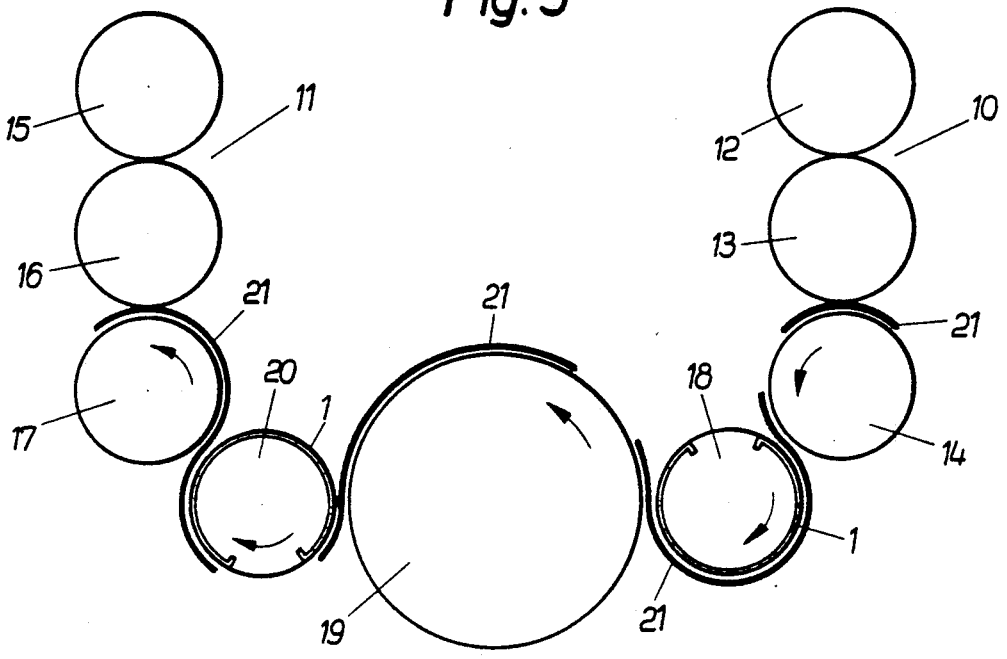
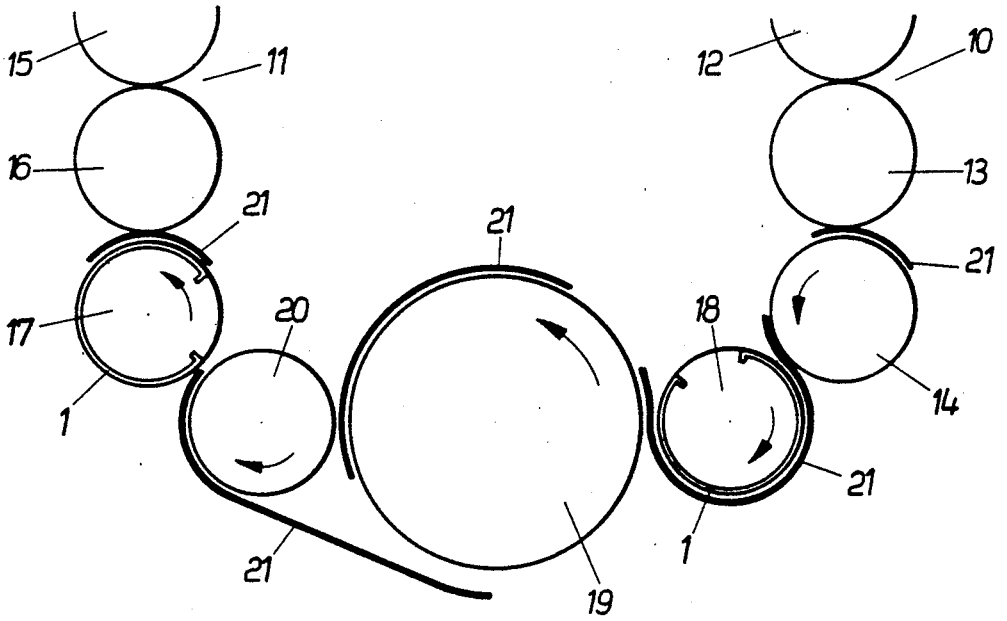
Fig. 4

IMPRESSION CYLINDER WITH DOMELIKE SURFACE PORTIONS OF UNIFORM HEIGHT

This application is a continuation of successive continuation applications Ser. Nos. 718,830, filed Apr. 2, 1985, 632,676, filed Jul. 19, 1984, 490,977, filed May 2, 1983, 357,663, filed Mar. 12, 1982, 171,837, filed Jul. 24, 1980, 927,664, filed Jul. 24, 1978, 752,094, filed Dec. 20, 1976, which is a continuation-in-part of application Ser. No. 614,609, filed Sept. 18, 1975, all of which have been abandoned.

The invention relates to a sheet guiding cylinder, including, for example a shell or cover for counter-pressure cylinders or sheet transfer cylinders in rotary printing presses, preferably obverse and reverse or perfector printing presses i.e. printing presses which print on one or both sides of a sheet. The sheert guiding cylinder is of the type having a surface formed with elevated surface portions distributed thereover to support a sheet on the printed side thereof.

An object of the invention is to minimize the build up or accumulation of ink on the cover surface of the cylinder that is in contact with the freshly printed side of a sheet by suitably dividing that surface into elevated supporting and lower-lying non-supporting surface portions.

In order to minimize the build-up or accumulation of ink on the sheet guiding cylinder, such as the shell or cover surface of a counter-pressure cylinder in contact with the freshly printed side of a sheet, it has been known heretofore from U.S. Pat. No. 2,011,181 to provide a perfector printing cylinder with a coat or covering formed of a fabric or paper on which small granules are secured. The granules have an elongated shape. They are distributed over the surface and disposed so that the major axis thereof, respectively extends perpendicularly to the fabric or paper web. They are secured to the fabric or the paper by glueing with glue or other adhesive at one of the ends thereof. The peaks or tips of the grains brace or support the sheet during the perfector printing operation on that side therof which was imprinted during the obverse or initial printing.

The heretofore known device of the aforementioned prior patent has a disadvantage in that the rough coat or covering of the counter-pressure cylinder is difficult to wash. Furthermore, neither paper, fabric nor the adhesive used to secure the grains is resistant to such chemicals as may come into contact with the printing plate. A consequence thereof is the necessity for frequently replacing the aforementioned heretofore known coat or covering which causes a marked increase in the length of the shut down time of the printing press. Although the aforementioned heretofore known coat or covering provided with granules for counter-pressure cylinders may continue to be utilizable for letters-press machines, it is unsuitable for use on offset printing presses due to the fulling or felling (Walkung) of the rubber blanket and the resulting tendency of the supporting fabric or paper for the granules to expand. This yielding of the covering or coating of the counter-pressure cylinder can be the cause of doubling or and, in the case of multicolor printing, of curtailing or reduced-size impressions. Furthermore, one must be concerned with the loss or dropping out of loosened granules. It has become known from German Patent No. 1 258 873 to cover counter-pressure cylinders and sheet transfer cylinders with an aluminum sheet that has been formed with a granular surface, anodized, sandblasted or treated in some other manner in order to attain a surface roughness; but this alone has not eliminated smudging and ink transfer. It has therefore been proposed, in the aforementioned German Patent No. 1 258 873, to provide the outer surface of a counter-pressure cylinder or sheet transfer cylinder per se, or an aluminum sheet or leaf associated therewith, with an ink-repelling chromium surface and, additionally, to roughen that surface, the roughness being between about 2 to 7.5 μm (R.M.S.). This roughness serves to reduce the actual sheet-supporting area of the outer surface of the cylinder.

The roughness of the chromium layer is produced by a treatment of the surface of the support, onto which the chromium is applied in the form of a thin layer. For example, the roughness may be produced by sandblasting. In such a case, as measurements of the surface roughness substantiate, points of support having a varying non-predeterminable geometrical configuration are locally produced in the support surface due to heterogeneous surface density, differences in hardness or differences in the blasting granules. During the subsequent chromium plating of the treated support surface, the previously produced uneven support or bearing surfaces are accurately shaped, so that the varying support surfaces produced during sand-blasting, the variations in the height thereof and irregular construction and distribution thereof are present in the completed cylinder outer surface.

The locally varying structure of the outer cylinder surface, especially in the case of half-tone printing, leads to correspondingly varying resistance to ink build-up, and when a multiplicity of items are imprinted on one sheet, this behavior is visible as a definite variation in quality within an impression or imprint. Furthermore, especially with thin papers, for high standard and exacting multicolor or the obverse or a single side of a sheet such an uneven or unsmooth outer surface of the counter-pressure cylinder is similarly prejudicial to quality, because the impresseion or imprint turns out partly varied due to nonuniform support during the printing operation.

It is accordingly an object of the invention, by using geometrically defined supporting parts, to provide a sheet guiding cylinder such as a shell or cover with a surface for counter-pressure cylinders and sheet transfer cylinders, on which little or no ink accumulates and which forms a uniform foundation for the entire impression or imprint so that uniform printing quality is assured. It is a further object of the invention to provide such a cover or shell with a surface that is wear-resistant and resistant to chemicals, especially those used for washing and activating the printing plate.

With the foregoing and other objects in view, there is provided, in accordance with the invention, a sheet guiding cylinder of a rotary printing press comprising a cylindrical member, at least the outer surface portion of which is formed of chemcically resistant, wear-resistant and unyielding material and has a multiplicity, of elevated solid surface portions consisting of a distribution of domelike structures of uniform height formed thereon.

By using a chemically resistant and wear-resistant material, such as metal, for example, for the entire shell surface, assurance is provided above all that, in spite of the chemicals used in the offset method, and even when processing rough papers, no unproductive or down time and consequent additional expense will be incurred. The particular advantage of a metal plate, however, is that it forms an imcompressible and practically nonexpansible foundation or base for the raised sheet-supportin surface portions. This characteristic is of particular importance with respect to the fulling or felling process (Walkung) in the offset method. A yielding underlay, such as would result from the felled balnket of a blanket cylinder would produce mackling or blurred printing, and would permit the occurrence of such faults as curtailing or reduced-size printing in the case of multicolor printing.

The disposition at uniform height of the domelike structures associated unyieldingly with the carrier thereof permits the formation of an impression of imprint of uniform quality. Moreover, the domelike structures have been found in numerous tests to be the optimally favorable construction for the supporting surfaces because they build or accumulate little ink, and that ink which accumulates is rapidly given up again. Furthermore, the domelike structures possess the advantage that, under increasing contact or compressive pressure, they form a rapidly and symmetrically enlarging sheet-supporting surface which preserves the impression or imprint and the sheet. Such a shell or cover surface exhibits little wear and is relatively easy to clean.

A rubber printing blanket in the surface of which rounded glass bodies or bodies of other solid substances are embedded has in fact already become known from German Patent Nos. 831 845 and 848 833. This heretofore known rubber printing blanket is, however, little suited for use in offset and multicolor printing; for example, in the case of the convertible multicolor-offset sheet printing presses, it behaves differently in the obverse or single side sheet printing setting, due to the expansibility and compressibility thereof, than the smooth impression cylinder of the other printing units. The result is mackling or variation in or blurring of the impression or imprint. In this case, for multicolor obverse or single-side sheet printing, the printing blanket would have to be exchanged for a covering or lining of the same thickness, the shutdown time being thereby increased, without giving regard to the difficulty of making available a covering or lining of this thickness having the required accuracy and hardness. Furthermore, a marked relationship or dependency between printing quality and contact pressure results.

A further disadvantage arises in the use of the aforementioned heretofore known rubber printing blanket due to the increasing electrostatic charging as compared to the unblanketed impression cylinders. Thus, for example, the electrostatic charging is not only increased, but also dissipation of the charge is actually prevented due to the insulating effect of the rubber printing blanket.

Also, in U.S. Pat. No. 3,126,826, an ink-repellent sheet is mentioned as a covering or lining for sheet transfer cylinders, the sheet being formed of a paper-like or cloth-like carrier with small glass beads embedded in rubber theron. In this case, too, the insulating effect produced by the rubber covering of the sheet transfer cylinder is disadvantageous. Furthermore, this covering or lining cannot be used on counter-pressure cylinders for the same reasons given hereinbefore with respect to rubber printing blankets.

In accordance with a further feature of the invention, the cylindrical member is a shell which, with the solid domelike structures formed theron, consists of nickel.

In accordance with another feature of the invention, the cylindrical member is formed of a nickel foil.

In accordance with an added feature of the invention, means are provided for securing the foil or the shell to a cylinder of the rotary printing press, the securing means being a clamping device.

As is generally known, nickel is incompressible, wear-resistant and also electrically conductive, in comparison to a rubber blanket. In tests, nhickel has proved to be extraordinarily resistant to the chemicals used in offset printing, as compared to chromium. The nickel foil can be manufactured by conventional electroplate molding or casting and, in accordance with yet another feature of the invention, is securable directly to a cylinder of the rotary printing press by an adhesive.

High stability is necessary in order for the nickel foil also to be fixed to guide wheels or discs, such as are provided, for example, in sheet transfer cylinders or delivery cylinders. In accordance with another feature of the invention, therefore, the nickel foil is copper-backed. Instead of copper-backing the nickel foil, it can also be clamped with an aluminum plate, for example, disposed beneath it.

In accordance with alternate features of the invention, the dome-like structures may be spherical, may have a substantially conical lateral surface covnerging to a substantially spherical extremity or may be paraboloidal.

In accordance with yet another feature of the invention, the spherical domelike structures have a diameter of substantially 0.1 mm and a height of substantially 0.02 mm, the mean distance between adjacent domelike structures being substantially 0.12 mm.

In accordance with a concomitant feature of the invention, the distribution of domelike structures is irregular. In this regard, it is noted, however, that there is a statistical uniformity of the raised surfaces which, with the uniform height of the domelike structures provides the aforementioned advantages over the prior art devices. Repeated testing has found that an absolutely symmetrical distribution of the domelike structures is disadvantageous since it results in moiré formation. A statistically uniform distribution is thus a distribution which is neither random nor exactly symmetrical but rather is nearly symmetrical yet has a prescribed irregularity which prevents moiré formation which occurs beyond an upper limit of the statistical uniformity.

Other features which are considered as characteristic for the invention are set forth in the appended claims.

Although the invention is illustrated and described herein as embodied in a sheet guiding cylinder in rotary printing presses, it is nevertheless not intended to be limited to the details shown, since various modifications and structureal changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is an enlarged diagrammatic cross-sectional view of a nickel foil forming part of a sheet guiding cylinder produced in accordance with the invention;

FIG. 2 is a diagrammatic plan view of FIG. 1;

FIG. 3 is a diagrammatic view of an obverse and reverse or perfector printing press i.e. a printing press which prints on either one or both sides of a sheet, which has three sheet transfer cylinders and is in the operative stage of obverse or single-side sheet printing FIG. 4 is another view of FIG. 3 with the printing press in a stage of operation for both obverse and reverse or perfector printing i.e. printing on both sides of a sheet;

FIG. 5 is a view similar to that of FIG. 4 of another embodiment of the printing press for printing on one or both sides of a sheet wherein the impression and sheet guide or transfer cylinders have double the diameter of the corresponding cylinders in the embodiment of FIG. 4.

Figure 6:
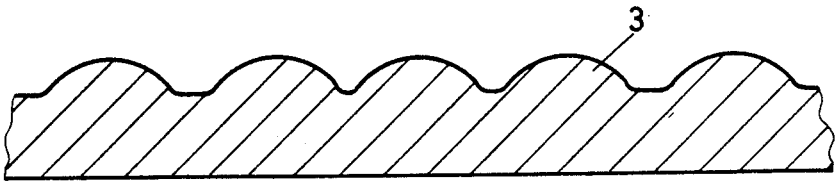
Figure 7:
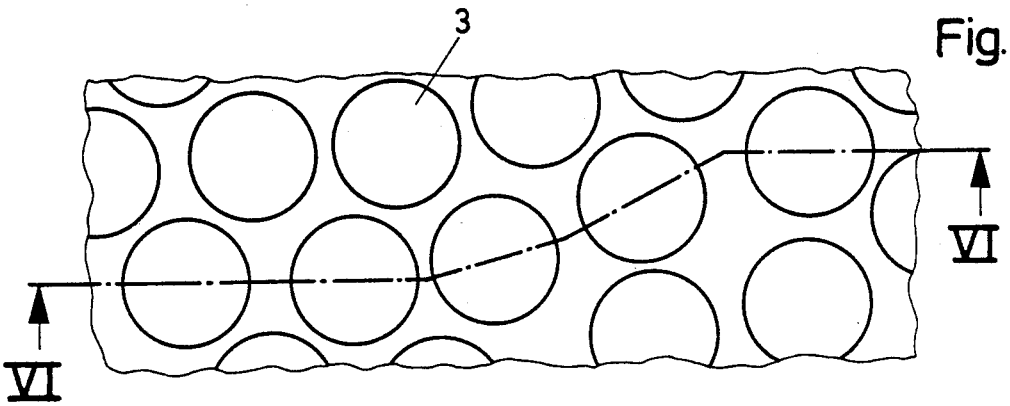
Figure 8:
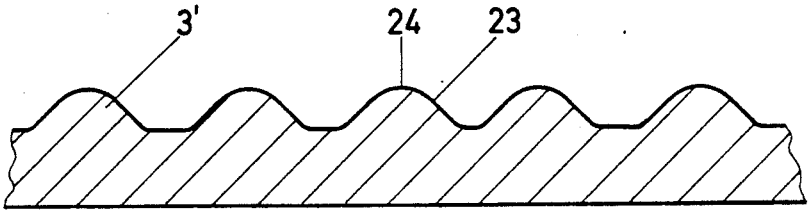
Figure 9:
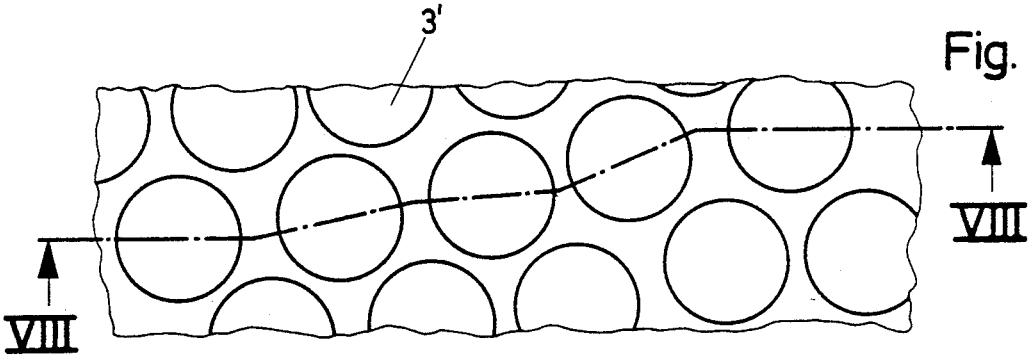
Figure 10:
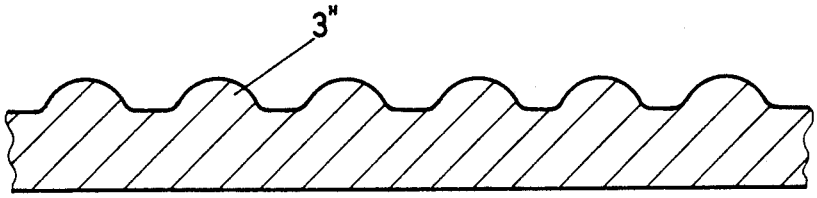
Figure 11:
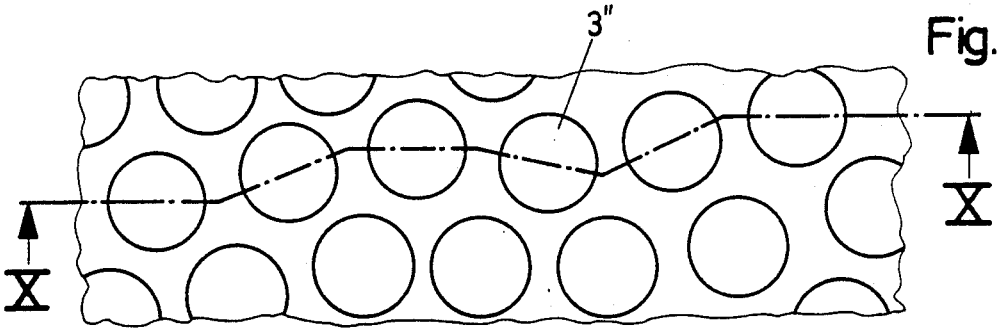

FIG. 6 is an enlarged fragmentary cross-sectional view of another embodiment of the sheet guiding cylinder taken along the line VI—VI in FIG. 7 and showing spherical domelike structures;

FIG. 7 is a top plan view of FIG. 6;

FIG. 8 is another cross-sectional view similar to that of FIG. 6 of another embodiment of the invention taken along the line VIII—VIII in FIG. 9 and showing domelike structures having a conical lateral surface converging to a spherical extremity;

FIG. 9 is a top plan view of FIG. 8;

FIG. 10 is yet another cross-sectional view similar to those of FIGS. 6 and 8 of another embodiment of the invention taken along the line X—X in FIG. 11 and showing paraboloidal domelike structures; and FIG. 11 is a top plan view of FIG. 10.

Referring now to the drawings and first, particularly, to FIG. 1 thereof, there is shown part of a sheet guiding cylinder according to the invention which is in the form of a foil 1 formed of nickel and having a thickness represented by the double-headed arrow 2 of 0.15 mm. The supporting surface portions of the surface of the nickel foil are constructed as domelike structures, more specifically spherical domes 3, having a diameter 4 of 0.1 mm. The spherical domes 3 are of equal height. The height 5 in the illustrated exemplary embodiment is 0.02 mm. The spherical domes 3 are arrayed in a distribution that is at least statistically uniform over the one surface of the nickel foil 1. As shown in FIG. 2, which is a diagrammatic representation of the foil 1, the means distance represented by the double-headed arrows 6 between two adjacent spherical domes 3 is approximately 0.12 mm. The aforementioned dimensions may be modified upwardly or downwardly within the scopes of the invention in accordance with requirements. Thus, for example, a nickel foil can also be manufactured with a thickness of 0.3 mm by the conventional method of electro-plate molding. The aforementioned dimensions are therefore to be considered to be only illustrative, but in no sense limitations.

The nickel foil 1 may be fixed on a cylinder by means of a suitable clamping or fastening device or directly, such as by adhesives. Because the supporting surface portions thereof are formed of individual identical spherical domes 3, the acceptance of printing ink from the wet impression or imprint and the surrender of the locally accepted printing ink to the next impression or imprint is the same across the entire sheet-supporting cover or shell surface and thus provides assurance of equal quality of all parts of the composition being imprinted. Due to the relatively slight thickness of the nickel foil 1, it is also possible to operate with the smoothly ground impression cylinder when there are especially high demands for obverse or single-side sheet printing, by simply removing the thin nickel foil 1. Compensation for the slight difference in diameter can easily be effected.

In FIGS. 3 to 5 advantageous applications of the nickel foil 1 are illustrated. FIGS. 3 and 4 show diagrammatically a sheet offset printing press having two printing units 10 and 11. Of these, the printing unit 10 is formed of a plate cylinder 12, a rubber or blanket cylinder 13 and an impression cylinder 14, and the printing unit 11 is formed of a plate cylinder 15, a rubber or blanket cylinder 16 and an impression cylinder 17. The two printing units 10 and 11 are connected by a sheet transfer cylinder 18 a storage or accumulator cylinder 19 and a sheet turning cylinder 20. In the obverse or single-side setting of the sheet printing press shown in FIG. 3, the sheet transfer cylinder 18 and the sheet turning cylinder 20 each carry nickel foil 1 formed in accordance with the invention. The reason for this is that both cylinders 18 and 20 support the sheet 21 at that side thereof that has been freshly imprinted in the printing unit 10.

The sheet 21 received a first impression, the so-called obverse impression, on the impression cylinder 14 from the rubber or blanket cylinder 13 in the printing unit 10. The sheet transfer cylinder 18 takes over the printed sheet 21, the freshly printed side of which being supported by the shell or cover surface of the nickel foil 1 on the cylinder 18. The sheet transfer cylinder 18 transfers the sheet 21 to the storage or accumulator cylinder 19, with the surface of which the nonimprinted side of the sheet 21 comes into contact. The freshly printed side of the sheet 21 does not again come into contact with the cover or shell surface of a cylinder until it reaches the sheet turning cylinder 20, and for this reason, as mentioned hereinbefore, a nickel foil 1 is likewise clamped on or secured by adhesive to this cylinder 20. The sheet 21 then receives a further impression or imprint, namely a second impression or imprint, on the previously imprinted side, by the rubber or blanket cylinder 16 in the printing unit 11.

When the offset printing press is converted to use for both obverse and reverse or perfector printing i.e. to printing on both sides of a sheet, according in FIG. 4, the nickel foil 1 inter alia is removed from the sheet-turning cylinder 20 and clamped onto or secured be adhesive to the impression cylinder 17. After the conversion of the machine is complete, the sheet 21 is likewise imprinted on one side thereof i.e. the obverse side, by the rubber or blanket cylinder 13 in the printing unit 10 and is advanced by the sheet transfer cylinder 18, which is covered with a nickel foil 1, to the sheet storage or accumulator cylinder 19. At the latter, by means of a non-illustrated conventional sheet-turning device, the rear or trailing edge of the sheet 21 is taken over by the sheet turning cylinder 20, so that also the unprinted side of the sheet 21 comes into contact with the sheet turning cylinder 20. Only when the sheet 21 has been taken over by the impression cylinder 17 of the second printing unit 11 is the previously imprinted side of the sheet 21 disposed against the outer surface of the impression cylinder 17, to which, therefore, a nickel foil 1 according to the invention is clamped or secured by adhesive.

The embodiment of the offset obverse and reverse or perfector printing press illustrated diagrammatically in FIG. 5 differs from the aforedescribed embodiment of FIGS. 3 and 4 in that the embodiment of FIG. 5 has two impression cylinder 14' and 17' which are twice the diameter of the plate cylinders 12 and 15 and rubber or blanket cylinders 13 and 16. Moreover, both printing units 10 and 11 are connected solely by a sheet transfer cylinder 22 constructed as a sheet turning cylinder. The sheet 21 received its first impression or imprint, the obverse impression, on the front side of the sheet, in the first printing unit 10 by means of the rubber or blanket cylinder 13 which is provided with a printing image by the plate cylinder 12. The sheet transfer cylinder 22 grips the freshly printed sheet 21 at the rear or trailing edge of the latter and transfers it turned i.e. with the rear or trailing edge thereof in forward or leading position, to the printing unit 11. The sheet 21 therefore rests upon the impression cylinder 17' with the printed front side of the sheet 21 against the cover or shell surface. Because the impression cylinder 17' is twice the diameter of the remaining printing unit cylinders 15 and 16, it has two sheet supporting cover or shell surfaces, both of which are provided with a respective nickel foil 1. In the second printing unit 11, the sheet 21 then receives an impression or imprint on the reverse side thereof, the so-called perfection. For this purpose the previously imprinted sheet is supported by the still freshly printed front side thereof against the nickel foil 1. Due to the construction of the nickel foil 1 in accordance with the invention, the first impression or imprint, the so-called prime, is not impaired in quality during this second printing operation.

The sheet guiding cylinder of the invention is in no way limited to the exemplary embodiment illustrated in FIGS. 1 and 2. Variations of the nickel foil are conceivable in that, instead of constructing spherical domes by means of electro-plate molding or casting, small balls of another solid chemically resistant material are embedded with uniform distribution in the nickel which serves as a solid carrier. It is also possible to replace the nickel foil by a similarly structured foil of synthetic or plastic material having a high modulus of elasticity.

Furthermore, as shown in FIGS. 6 to 11, different shapes of the domelike structures may be employed in accordance with the invention. Thus, in FIGS. 6 and 7, solid spherical domelike structures 3 similar to those shown in FIG. 1 extend from the cylinder per se or a covering shell or foil, it being noted in the actual plan view of FIG. 7 that the distribution of the spherical domelike structures 3 on the surface of the cylinder or shell is somewhat irregular but, nevertheless, statistically substantially uniform.

In FIGS. 8 and 9, the domelike structures 3' have a substantially conical lateral surface 23 converging to a substantially spherical extremity 24 and are again physically distributed irregularly, though statistically rather uniform.

in FIGS. 10 and 11, the domelike structures 3'' are paraboloidal and also have an irregular actual distribution which is, nevertheless, considered to be substantially uniform from a statistical standpoint.

A characteristic of all of the differently shaped domelike structure is, of course, that they are domelike in appearance, and that they, within a given distribution of the same shape, are substantially uniform in height.

It is also noted that all of the domelike structures are solid i.e. not thin sheetmetal shells, and are integral with the cylindrical base foil or shell which is mountable on a sheet guiding cylinder or are, in fact, integral with the sheet guiding cylinder per se.

With respect to the distribution of the domelike structures, they may actually be disposed in somewhat irregular fashion, as shown in FIGS. 7, 9, and 11, over given areas of the foil, shell or surface of the sheet guiding cylinder per se, however, further in accordance with the invention, those areas may constitute a repeating pattern having a net effect of affording statistical uniformity.

There are claimed:

1. An impression cylinder of a rotary offset printing press comprising a metal cylindrical member of chemically resistant, wear-resistant and unyielding material formed in one continuous piece with a multiplicity of elevated non-hollow solid surface portions formed of said one-piece material said surface portions being domelike and of uniform height, and having a distribution which is statistically uniform yet sufficiently irregular to prevent moiré formation, a cylinder body, and means for rigidly securing said cylindrical member to said cylinder body.

2. An impression cylinder according to claim 1 wherein said member is a shell which, with said solid domelike structures formed thereon, consists of nickel.

3. An impression cylinder according to claim 2 wherein said member is formed of a nickel foil.

4. An impression cylinder according to claim 3 wherein said nickel foil is copper-backed.

5. An impression cylinder according to claim 1, wherein said domelike structures are spherical.

6. An impression cylinder according to claim 1 wherein each of said domelike structures has a substantially conical lateral surface converging to a substantially spherical extremity.

7. An impression cylinder according to claim 1 wherein said domelike structures are paraboloidal.

* * * * *